US010204551B2

(12) United States Patent
Zhang

(10) Patent No.: US 10,204,551 B2
(45) Date of Patent: Feb. 12, 2019

(54) OLED DRIVING CIRCUIT AND OLED DISPLAY

(71) Applicant: Wuhan China Star Optoelectronics Technology Co., Ltd., Wuhan, Hubei (CN)

(72) Inventor: Di Zhang, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 68 days.

(21) Appl. No.: 15/328,599

(22) PCT Filed: Dec. 30, 2016

(86) PCT No.: PCT/CN2016/113352
§ 371 (c)(1),
(2) Date: Jan. 24, 2017

(87) PCT Pub. No.: WO2018/119975
PCT Pub. Date: Jul. 5, 2018

(65) Prior Publication Data

US 2018/0211593 A1 Jul. 26, 2018

(30) Foreign Application Priority Data

Dec. 28, 2016 (CN) ..... 2016 1 1232646

(51) Int. Cl.
*G09G 3/3233* (2016.01)

(52) U.S. Cl.
CPC ... *G09G 3/3233* (2013.01); *G09G 2300/0443* (2013.01); *G09G 2300/0861* (2013.01); *G09G 2310/0251* (2013.01); *G09G 2310/0262* (2013.01); *G09G 2320/043* (2013.01)

(58) Field of Classification Search
CPC ..... G09G 3/3233; G09G 2320/043; G09G 2300/0443; G09G 2310/0251; G09G 2300/0861; G09G 2310/0262
See application file for complete search history.

(56) References Cited

U.S. PATENT DOCUMENTS

2009/0135114 A1* 5/2009 White ..... G09G 3/007 345/78
2015/0332628 A1* 11/2015 Ren ..... G09G 3/3258 345/690
2016/0155381 A1* 6/2016 Kwon ..... G09G 3/3233 345/215

FOREIGN PATENT DOCUMENTS

CN 101878499 A 11/2010
CN 103236237 A 8/2013
CN 104715717 A 6/2015
CN 106205473 A 12/2016

* cited by examiner

*Primary Examiner* — Abhishek Sarma
(74) *Attorney, Agent, or Firm* — Andrew C. Cheng

(57) ABSTRACT

An OLED driving circuit is disclosed. The OLED driving circuit includes at least two types of pixel driving circuits for driving each pixel of an OLED display panel. The at least two types of the pixel driving circuits have different types and/or amounts of elements so a different pixel driving circuit is designed for each pixel. In comparison with a current display panel using the same driving circuit, a part of the pixel driving circuit is simplified to simplify a structure and to reduce a space occupied by the OLED driving circuit on an effective area of the display panel.

6 Claims, 4 Drawing Sheets

OLED DRIVING CIRCUIT AND OLED DISPLAY

FIELD OF THE INVENTION

The present invention relates to a display driving circuit, and more particularly to an OLED driving circuit and an OLED display.

BACKGROUND OF THE INVENTION

The continuous development of science and technology makes the electronic display technology is constantly upgrading. People are also seeking a larger screen, higher resolution and more exciting visual effects. An organic light-emitting diode (OLED) screen has advantages including a high contrast, a wide visual angle, a high saturation, a low power consumption etc. These advantages undoubtedly push the OLED screen to the forefront of display market development.

A basic structure of the OLED mainly includes: an electron transport layer, a light-emitting layer and a hole transport layer. When a power supplies an appropriate voltage, electrons and holes are respectively injected from a cathode and an anode to an organic functional film sandwiched in between the electrodes. The injected electrons and holes are respectively migrated from the electron transport layer and the hole transport layer to the light-emitting layer. The electrons and holes recombine to produce excitons. The excitons are migrated under an action of an electric field to transfer an energy to luminescent molecules and to excite the electrons to transit from a ground state to an excited state. An excited state energy produces photons through a radiation transition.

The liquid crystal display (LCD) is a voltage-driven element, The liquid crystal can normally operate if a required voltage is provided within a required time. The LCD is not sensitive to current changes. However, the OLED is a current-driven element, so different currents result in different brightness of the OLED. Therefore, a pixel driving circuit of the OLED is more complex.

The current display panels employs the same driving circuit, so it is difficult to proceed a PCB layout scheme under a condition that meet with design requirements including devising requirements of a high pixel per inch (PPI), a high screen ratio and a high resolution.

With the development requirements of the high PPI, narrow borders and a high resolution for the display screen, a driving circuit which adapts to the high PPI requirement and overcomes a layout space issue is required urgently.

SUMMARY OF THE INVENTION

An objective of the present invention is to provide a driving circuit having a stronger mura compensation function. Another objective of the present invention is to provide a driving circuit that meets with requirements of the high PPI and the high screen ratio.

According to another aspect of the present invention, an OLED driving circuit is provided and includes at least two types of pixel driving circuits for driving each pixel of an OLED display panel. The at least two types of the pixel driving circuits respectively have different types and/or amounts of elements.

Accordingly, different pixel driving circuits may be provided respectively for the pixels. In comparison with a current display panel using the same driving circuit, a part of the pixel driving circuits is simplified to simplify a structure thereof and to reduce a space occupied by the OLED driving circuit on an effective area of the display panel.

Optionally, different pixel driving circuits are devised respectively according to wavelengths or colors of the light emitted from the pixels. Accordingly, the structure can be simplified to reduce the space occupied by the OLED driving circuit on the effective area of the display panel.

The at least two types of the pixel driving circuits may include: a first pixel driving circuit used to drive a first pixel to emit a light with a wavelength exceeding a predetermined wavelength range; a second pixel driving circuit used to drive a second pixel to emit a light with wavelength being within the predetermined wavelength range. Accordingly, the space occupied by the OLED driving circuit on the effective display area of the display panel is reduced.

The at least two types of the pixel driving circuits may include: a first pixel driving circuit used to a first pixel to emit a light with a brightness non-uniformity being less sensitive for a human eye and a second pixel driving circuit is used to drive a second pixel to emit a light with a brightness non-uniformity being more sensitive for the human eye. Accordingly, the space occupied by the OLED driving circuit on the effective display area of the display panel is reduced without affecting users' experience.

The amount of the elements included in the first pixel driving circuit is less than that of the second pixel driving circuit. Accordingly, the space occupied by the OLED driving circuit on the effective display area of the display panel is reduced.

An amount of thin-film transistors included in the first pixel driving circuit is less than that of the second pixel driving circuit. Accordingly, the space occupied by the OLED driving circuit on the effective display area of the display panel is reduced.

Optionally, the first pixel driving circuit does not include an inner compensating circuit but the second pixel driving circuit includes an inner compensating circuit. Accordingly, the space occupied by the OLED driving circuit on the effective display area of the display panel is reduced.

The first pixel may include a red pixel and/or blue pixel and the second pixel may include a green pixel and/or yellow pixel. Accordingly, the space occupied by the OLED driving circuit on the effective display area of the display panel is reduced without affecting the users' experience.

The first pixel driving circuit comprises a first thin-film transistor for switching, and a second thin-film transistor for driving and a capacitor. A gate of the first thin-film transistor is electronically connected to a scan line, a drain thereof is electronically connected to a data line and a source thereof is electronically connected to a gate of the second thin-film transistor and one end of the capacitor. A drain of the second thin-film transistor is connected to a DC voltage and a source thereof is electronically connected to the other end of the capacitor and an anode of an OLED. A cathode of the OLED is connected to a ground.

Wirings of the first pixel driving circuit may be arranged on peripheries of the display panel to reduce the space occupied by the OLED driving circuit on the effective display area of the display panel.

Optionally, the first pixel driving circuit also includes an external compensating unit electronically connected to the anode of the OLED to sense a voltage or current of the OLED.

The external compensating unit may include: a third thin-film transistor electronically connected to the anode of the OLED, and an external driving IC electronically connected to the third thin-film transistor. The external compensating unit senses the current of the OLED through the third thin-film transistor and the external driving IC and changes data transmitted by the data line according to the sensed current to keep a uniform brightness of OLED.

The external compensating unit may be used to compensate the current of the blue pixel.

According to another aspect of the present invention, an OLED display is provided and includes a display panel. The OLED display also includes the OLED driving circuit as above-mentioned.

The space occupied by the OLED driving circuit in accordance with embodiments of the present invention on the effective display area of the display panel is reduced to meet the requirements of a high PPI and a screen ratio. In addition, the OLED driving circuit in accordance with embodiments of the present invention has a function of compensating a higher threshold voltage to make that the OLED display panel has a better display effect.

BRIEF DESCRIPTION OF THE DRAWINGS

These and/or other aspects and advantages of the present invention become clear and more understandable from following descriptions of the embodiments accompanied with drawings.

DETAILED DESCRIPTION OF THE PREFERRED EMBODIMENTS

Figure 1:
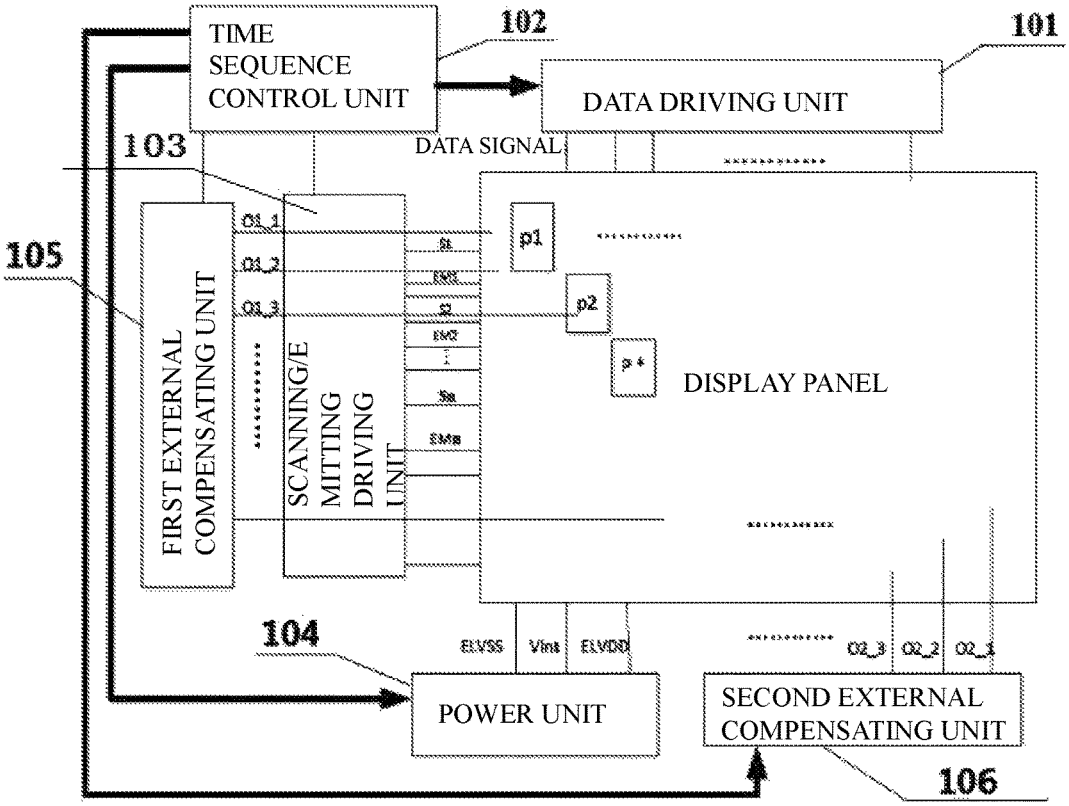
FIG. 1 is a layout schematic view of a circuit module of a display panel in accordance with an embodiment of the present invention.

Embodiments of the present invention are described in detail, wherein the same reference numerals refer to the same elements throughout. Hereinafter, embodiments are described with reference to the drawings to explain the present invention.

According to embodiments of the present invention, a pixel driving circuit is used to drive each pixel of an Organic light-emitting Diode (OLED) panel. According to the embodiments of the present invention, different pixel driving circuits are disposed according to the pixels emitting different light colors. In addition, according to the embodiments of the present invention, the pixels emitting different light colors are grouped and a pixel driving circuit is designed for each group. The present invention is not limited by this embodiment.

The OLED emits a visible light and a color of the visible light generally includes red, orange, yellow, green, blue, purple etc. Base on a tissue and vision aspects, the human eye has a greatest visual sensitivity for the green light. As a wavelength of the light increases or decreases, the visual sensitivity of the human eye is decreased. In other words, the human eye has a less sensitivity to brightness non-uniformities of a red light having a higher wavelength in a visible light and the blue light having a lower wavelength in the visible light. The sensitivity of the human eye to light may be different far different people, but the overall can be distinguished according to the wavelength of visible light. For example, a light having a wavelength within a predetermined wavelength range (such as 500 nm-600 nm) is regarded as the light (such as the green light or yellow light) that is sensitive to the human eye and a light having a wavelength exceeding the predetermined wavelength range is regarded as a light (such as the red light or blue light) that is not sensitive to the human eye According to the embodiments of the present invention, the pixel driving circuits of the OLED display panel are classified to at least two types of the pixel driving circuits based on the wavelengths of the lights emitted from the pixels of the OLED display panel by a characteristic that is the sensitivity of the human eye to the different brightness non-uniformities. As a whole, a space occupied by the OLED driving circuit on an effective display area of the OLED display panel is reduced.

For example, based on the above-mentioned characteristic, the present invention classifies a red pixel and a blue pixel (emitting a light with a wavelength exceeding the predetermined wavelength range, such as 500 nm-600 nm) that are not sensitive to the human eye in a group and classifies a yellow pixel and a green pixel (emitting a light with a wavelength being within the predetermined wavelength range, such as 500 nm-600 nm) that are sensitive to the human eye in another group. The present invention respectively devises different driving circuits. The embodiments of the present invention are further described in detail with reference to the drawings. To describe conveniently, a pixel, a pixel unit or a pixel module for emitting a light with a specific color is called a pixel with a corresponding color. For example, the pixel, pixel unit or pixel module for emitting red light is called a red pixel.

FIG. 1 is a layout schematic view of a circuit module of an embodiment of the display panel in accordance with the present invention.

As shown in FIG. 1, a circuit module of the display panel in accordance with the embodiment of the present invention includes a data driving unit 101, a time sequence control unit 102, a scanning/emitting driving unit 103, a power unit 104, a first external compensating unit 105 and a second external compensating unit 106.

The time sequence control it 102 controls time sequences of the data driving unit 101, the scanning/emitting driving unit 103, the power unit 104, the first external compensating unit 105 and the second external compensating unit 106 to provide data signals to the data driving unit 101 through data lines and to provide scanning signals S1, S2 . . . Sn and emission signals EM1, EM2, EM3 . . . EMn. to the scanning/emitting driving unit 103 through scan lines. The power unit 104 provides a positive terminal ELVDD, a negative terminal or a ground terminal ELVSS of a DC voltage and an initial pixel voltage Vint. The first external compensating unit 105 provides first compensating signals O1_1, O1_2, O1_3 etc. to the display panel. The second external compensating unit 106 provides second compensating signals O2_1, O2_2, O2_3 etc. to the display panel. The previously-mentioned compensating signals are used to compensate different color pixels of the display panel to keep a uniform brightness thereof The compensating signals are further described in detail.

Based on a limitation of devising layout aspect, the above-mentioned signal lines are connected to the display panel through sides of the display panel. Under a condition having more thin-film transistors, more complex circuit module and more signal lines, more space of the sides of the display panel is occurred. This results in a reduction of the effective area of displaying video or image, so that a high PPI and high screen ratio requirements are not met.

According to the embodiment of the present invention, the pixel driving circuits of the OLED display panel are classified to the at least two types of the pixel driving circuits based on the wavelengths of the lights, which uses the characteristic according to the sensitivity of the human eye to the different brightness non-uniformities. For example, the at least two types of the pixel driving circuits may include a first pixel driving circuit and a second pixel driving circuit. The first pixel driving circuit is used to drive a first pixel having a brightness that is not sensitive to the human eye. The second pixel driving circuit is used to drive a second pixel having a brightness that is sensitive to the human eye. To describe conveniently, FIG. 1 does not show the pixel driving circuit in details in accordance with the embodiment of the present invention, but person skilled in the art knows corresponding disposing positions and structures thereof in the display panel.

Figure 2:
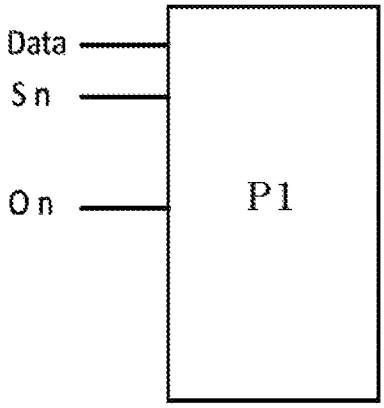
FIG. 2 is a layout drawing of a first pixel driving circuit in accordance with an embodiment of the present invention.
Figure 3:
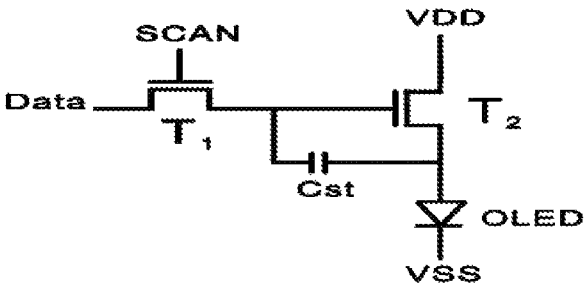
FIG. 3 is a theory drawing of the first pixel driving circuit in accordance with the embodiment of the present invention.

The first pixel driving circuit in accordance with an embodiment of the present invention accompanied with FIGS. 2 and 3 is further described in detail.

FIG. 2 is a layout drawing of the first pixel driving circuit of the embodiment in accordance with the present invention.

As shown in FIG. 2, P1 is a driving circuit of the pixel having a brightness non-uniformity that is not sensitive to the human eye. For example, the pixel corresponding to P1 may be the red pixel or blue pixel. The data Data provided by the data driving unit (such as, the data driving unit 101 shown in FIG. 1), the scanning signal Sn provided by the scanning/emitting driving unit (such as, scanning/emitting driving unit 103), the DC voltage ELVDD and ELVSS (not drawn) provided by the power unit (such as the power unit 104 shown in FIG. 1) and the compensating signal On provided by the external compensating unit (such as the first external compensating unit 105 shown in FIG. 1) are supplied to the pixel driving circuit P1.

Since the human eye has a low sensitivity to the brightness non-uniformities of the above-mentioned pixels, an inner compensating unit is not devised in the pixel driving circuit corresponding to the pixel in accordance with the present invention when a threshold voltage drift issue of the thin-film transistor is not considered. Therefore, a structure of the driving circuit is simpler and the occurred space of the effective display area is smaller.

As shown in FIG. 3, the first pixel driving circuit in accordance with the embodiment of the present invention includes: a first thin-film transistor T1 for switching, a second thin-film transistor T2 for driving, a capacitor Cst for storing data and an organic light-emitting diode OLED for emitting light.

A gate of the first thin-film transistor T1 is connected to the scan line SCAN, a drain is connected to the data line Data and a source is connected to a gate of the second thin-film transistor T2 and one end of the capacitor Cst.

A drain of the thin-film transistor T2 is connected to the DC voltage VDD, a source of the thin-film transistor. T2 is connected to another end of the capacitor Cst and an anode of the organic light-emitting diode OLED and a cathode of the organic light-emitting diode OLED is connected to the ground.

The scan line SCAN outputs a high level or low level to the gate of the first thin-film transistor T1. When the scan line SCAN outputs a high level voltage, the first thin-film transistor T1 turns on, the data transmitted by the data line Data is provided to the gate of the second thin-film transistor T2 and stored in the capacitor Cst.

In a process of switching an image data of the display panel from nth frame to (n+1)th frame, the data stored in the capacitor Cst may keep the high level voltage of the gate of the second thin-film transistor for a while, so the organic light-emitting diode OLED keeps emitting the light before the (n+1)th frame of the display panel is appeared.

The first pixel driving circuit in accordance with the embodiment of the present invention meets with the high. PPI and the high screen ratio requirements of the display panel.

However, the first pixel driving circuit in accordance with the embodiment of the present invention does not have a function of compensating the threshold voltage. When the OLED is used for a long time, the non-uniformity sensed by the human eye may be increased. Therefore, the first pixel driving circuit in accordance with the embodiment of the present invention may further include the external compensating unit (such as the first and second external compensating units 105, 106).

Figure 4:
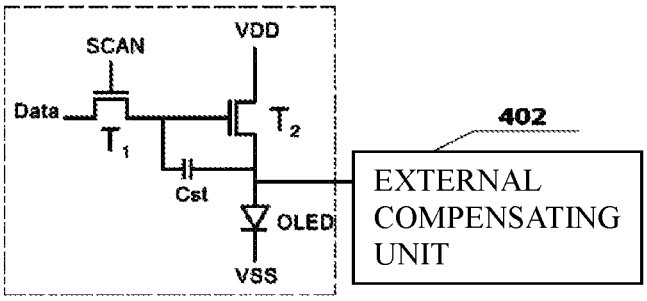
FIG. 4 is a schematic view of an external compensation unit of the first pixel driving circuit in accordance with an embodiment of the present invention.

FIG. 4 is a schematic view of the external compensation unit of the first pixel driving circuit of an embodiment in accordance with the present invention.

As shown in FIG. 4, in addition to the elements of the pixel driving circuit shown in FIG. 3, the first pixel driving circuit in accordance with another embodiment of the present invention further includes an external compensating unit 402. The external compensating unit 402 is connected to the anode of the OLED. The external compensating unit can sense a voltage dropped between two ends of the OLED or a current passing through the OLED and changes the data inputted to the drain of the first thin-film transistor T1 for switching based on the sensed current to keep the uniform brightness of the OLED.

Figure 5:
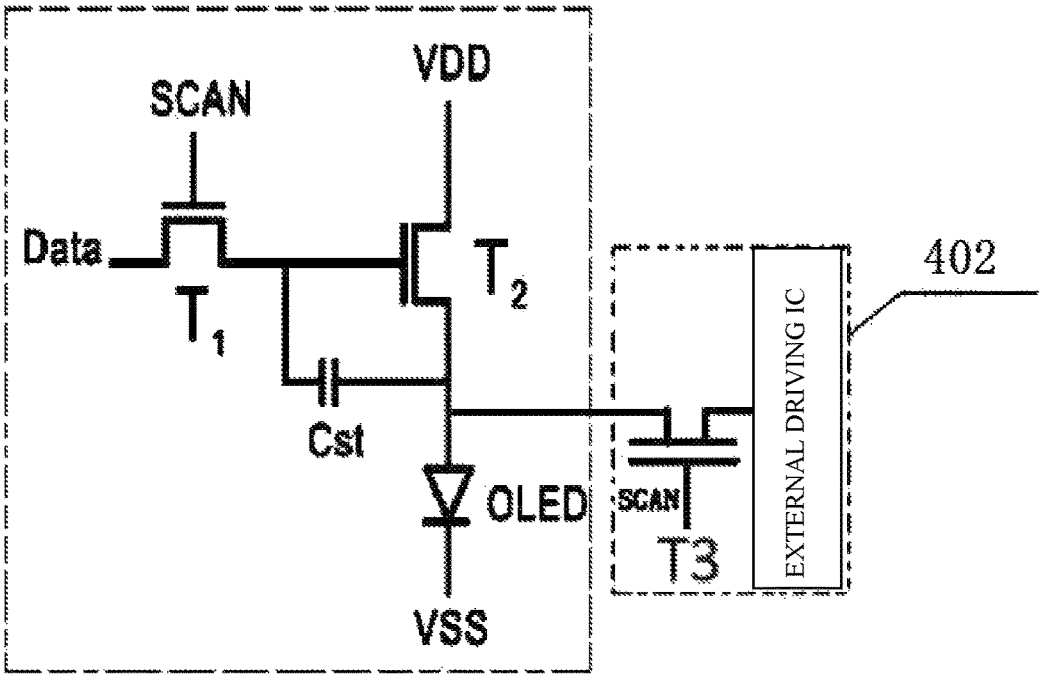
FIG. 5 is structural schematic view of the external compensation unit in accordance with the embodiment of the present invention.

FIG. 5 is structural schematic view of the external compensation unit of the embodiment in accordance with the present invention.

As shown in FIG. 5, the external compensating unit 402 includes a third thin-film transistor T3 whose anode is electronically connected to the OLED and an external driving IC connected to the third thin-film transistor T3. The external compensating unit 402 can sense the current passing through the OLED by the third thin-film transistor and the external driving IC and adjusts the data inputted to the drain of the first thin-film transistor T1 for switching based on the sensed current to keep the uniform brightness of the OLED.

When wirings of the external compensating unit are less relatively, the brightness non-uniformity may be compensated by a way of commonly-using the data lines or independently-wiring on a single side. When the wirings of the external co p sating unit are more relatively, the wirings of the external compensating unit are arranged on peripheries of the effective display area to effectively reduce the space occurred by the wirings of the external compensating unit.

The first pixel driving circuit in accordance with the embodiment of the present invention may include the external compensating unit and keeps the uniform brightness of the OLED (such as blue OLED or red OLED) through the external compensating unit to increase a usage life of the OLED when a mura phenomenon is eased. In addition, an amount of the thin-film transistors included in the external compensating unit in accordance with the embodiment of the present invention is less, so a circuit structure is simple. The occupied space of the effective display area of the display panel is reduced.

Figure 6:
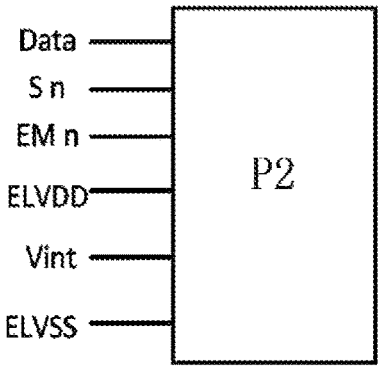
FIG. 6 is a layout drawing of a second pixel driving circuit in accordance with an embodiment of the present invention.
Figure 7:
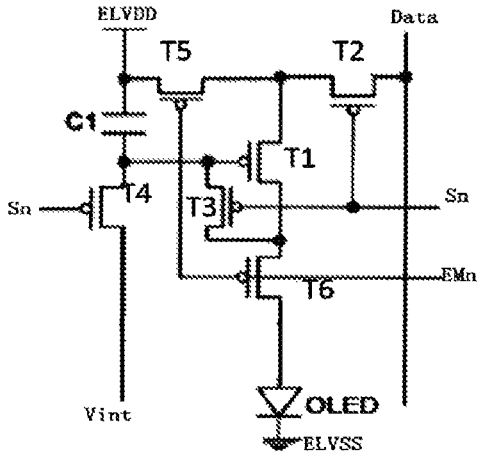
FIG. 7 is a theory drawing of the second pixel driving circuit in accordance with the embodiment of the present invention.

The second pixel driving circuit in accordance with an embodiment of the present invention accompanied with FIGS. 6 and 7 is further described. FIG. 6 is a layout drawing of the second pixel driving circuit in accordance with the embodiment of the present invention. FIG. 7 is a theory drawing of the second pixel driving circuit in accordance with the embodiment of the present invention, As shown in FIGS. 6 and 7, in order to reduce the occurred space of the effective display area of the display panel and meet requirements of a high resolution and a better threshold voltage compensation, the second pixel driving circuit is devised for the pixel having the brightness that is sensitive to the human eye in accordance with the embodiment of the present invention.

As shown in FIG. 6, P2 is a driving circuit of the pixel having a brightness non-uniformity that is sensitive to the human eye. The pixel corresponding to P2 may be the yellow pixel or the green pixel.

The data Data provided by data driving unit (such as, the data driving unit 101 shown in FIG. 1), the scanning signal Sn provided by the scanning/emitting driving unit (such as, scanning/emitting driving unit 103) and the DC voltage ELVDD, the ground terminal ELVSS and the initial voltage Vint provided by the emitting signal EMn, the power unit (such as the power unit 104 shown in FIG. 1) are supplied to the pixel driving circuit P2.

Since the human eye is sensitive to the brightness non-uniformities of the pixel corresponding to P2, the inner compensating unit is devised in the pixel driving circuit corresponding to the pixel in accordance with the embodiment of the present invention when the threshold voltage drift issue of the thin-film transistor is considered. Accordingly, the requirements of the high resolution and the better threshold voltage compensation are met.

As shown in FIG. 7, the second pixel driving circuit in accordance with the embodiment of the present invention includes: a first thin-film transistor T1 for driving, multiple second thin-film transistors T2 to T6 for switching, a capacitor C1 and an organic light-emitting diode OLED for emitting light.

As shown in FIG. 7, a theory of the second pixel driving circuit is similar to that of FIG. 3, but the second pixel driving circuit shown in FIG. 7 adds four second thin-film transistors on a basis of FIG. 3. The concrete connecting relationship and detailed structure is shown in FIG. 7 and not further described redundantly.

The second pixel driving circuit as shown in FIG. 7 uses an inside-compensating way to make that a driving current passing through the first thin-film transistor for driving is not related to a threshold voltage of the second thin-film transistor for switching. A deterioration of the display image caused by the threshold voltage drift of the thin film transistor for driving is eliminated.

Although this type of the pixel driving circuit has a complex structure and the occurred space of the effective area of the display panel is larger relatively, it has the inside-compensating function to meet the higher resolution, the better threshold voltage compensation and a function of drift-compensating requirements.

As foregoing described description, parts of the pixels of the present invention have the driving circuits each of which has a function of compensating threshold voltage but occurs the larger space of the effective area of the display panel, and other parts of the pixels of the present invention have the driving circuits each of which occurs smaller space of the effective area of the display panel. Accordingly, under a condition that a better display image and the higher resolution are provided, the high PPI and high screen ratio requirements are met as far as possible.

According to the embodiments of the present invention, by the characteristic that is the sensitivity of the human eye to the different brightness non-uniformities, two or more than two driving circuits are designed based on the wavelengths of the lights.

In addition, the first and second pixel driving circuits previously described by combining the drawings are merely examples, and any known driving circuits or the like may be selected as the first and second pixel driving circuits.

According the embodiments of the present invention, the external compensating circuit is provided to a pixel using a single-color organic light-emitting diode with a shorter usage life to decrease an amount of the thin-film transistors and extend the usage life of the corresponding organic light-emitting diode.

The above embodiments of the present disclosure are preferred embodiments, but do not limit the scope of the present invention. It should be noted that people who skilled in the filed make improvements and polishes within the principles of the present disclosure and these improvements and polishes should be covered in the scope of the present disclosure. Therefore, the scope of the present invention should be constructed by the scope of the claims.

What is claimed is:

1. An OLED driving circuit, comprising at least two types of pixel driving circuits to drive each pixel of an OLED display panel, wherein the least two types of the pixel driving circuit respectively have different types and/or amounts of elements;

wherein the at least two types of the pixel driving circuits comprises: a first pixel driving circuit only used to drive a first pixel selected from a red pixel and a blue pixel which emit a light with a wavelength exceeding a predetermined wavelength range or whose brightness non-uniformity is less sensitive for a human eye; and a second pixel driving circuit only used to drive a second pixel selected from a yellow pixel and a green pixel which emit a light with a wavelength being within the predetermined wavelength range or with a brightness non-uniformity being more sensitive for the human eye;

wherein the amount of the elements included in the first pixel driving circuit is less than that of the second pixel driving circuit; or an amount of the thin-film transistors included in the first pixel driving circuit is less than that of the second driving circuit to reduce a space of an effective area of the display panel occupied by the driving circuits;

wherein the first pixel driving circuit does not comprise an inner compensating circuit, but the second pixel driving circuit comprises the inner compensating circuit; and wherein the second pixel driving circuit includes at least four thin-film transistors, and the second pixel driving circuit receives a data provided by a data driving unit, a scanning signal and a emitting signal provided by a scanning/emitting driving unit and a DC voltage, a ground terminal and an initial voltage provided by a power unit.

2. The OLED driving circuit according to claim 1, wherein the first pixel driving circuit comprises a first thin-film transistor for switching, a second thin-film transistor for driving and a capacitor;

a gate of the first thin-film transistor is electronically connected to a scan line, a drain thereof is electronically connected to a data line and a source thereof is electronically connected to a gate of the second thin-film transistor and one end of the capacitor;

a drain of the second thin-film transistor is connected to a DC voltage and a source thereof is electronically connected to the other end of the capacitor and an anode of an OLED; and a cathode of the OLED is connected to a ground.

3. The OLED driving circuit according to claim 1, wherein the first pixel driving circuit further comprises an external compensating unit electronically connected to an anode of an OLED to sense a voltage or current of the OLED.

4. The OLED driving circuit according to claim 3, wherein the external compensating unit comprises:

a third thin-film transistor electronically connected to the anode of the OLED; and an external driving IC electronically connected to the third thin-film transistor;

wherein the external compensating unit sense the current of the OLED by the third thin-film transistor and external driving IC to change data transmitted by a data line according to the sensed current to keep a uniform brightness of the OLED.

5. The OLED driving circuit according to claim 3, wherein the external compensating unit is used to compensate current of a blue pixel of each pixel.

6. An OLED display, comprising an OLED driving circuit and a display panel as claimed in claim 1.

* * * * *